United States Patent [19]

Sellors

[11] Patent Number: 4,458,837

[45] Date of Patent: Jul. 10, 1984

[54] MULTICELL CARTON AND METHOD

[75] Inventor: Thomas J. Sellors, Winthrop Harbor, Ill.

[73] Assignee: Olympic Packaging, Inc., Mundelein, Ill.

[21] Appl. No.: 350,084

[22] Filed: Feb. 18, 1982

[51] Int. Cl.[3] ..... B65D 5/48

[52] U.S. Cl. ..... 229/28 R; 229/29 C

[58] Field of Search ..... 229/28 R, 29 B, 29 C, 229/29 D, 27, 29 E

[56] References Cited

U.S. PATENT DOCUMENTS

| | | | |
|---|---|---|---|
| 2,759,652 | 8/1956 | Burgess | 229/28 R |
| 3,229,889 | 1/1966 | Vrana | 229/28 R |
| 3,514,031 | 5/1970 | Burgess | 229/28 R |
| 3,743,168 | 7/1973 | Forbes, Jr. | 229/28 R |
| 4,117,972 | 10/1978 | Sellors | 229/28 R |
| 4,274,579 | 6/1981 | Kulig | 229/28 R |

*Primary Examiner*—Steven M. Pollard
*Assistant Examiner*—Bryon Gehman
*Attorney, Agent, or Firm*—Jack E. Dominik

[57] ABSTRACT

Disclosed is a multicell carton having a base element with side panels, and gang lift elements formed as an extension from the side panels. More specifically, a breakaway strut panel is integrally formed with the initial panel, and thereafter folded over and glued, and severed from the initial panel in order to define the divider strut between the two strut gang lift elements. A divider strut glue flap extends from one of the gang lift elements and is secured to the single thickness breakaway strut, thereby reducing the board construction from approximately 235 square inches for the carton as shown in U.S. Pat. No. 4,274,579 to 225 square inches or a 10 square inch saving amounting to a 4.3% reduction in the use of board. The method of the invention contemplates first glueing the breakaway strut portion to the graphic panel and then severing the same by sawing or otherwise cutting to form an independent element on the underneath portion of the graphic panel. Thereafter the strut fold score results in a 180° folding of the divider strut and its breakaway strut assembly to form the first gang element of the carton. Subsequently, the glue strip is adhered to the divider strut, the divider strut glue panel folded 180°, and the strut gang lift section folded along the final fold score to complete the glueing of the divider strut glue flap to the divider strut and complete the carton construction.

8 Claims, 14 Drawing Figures

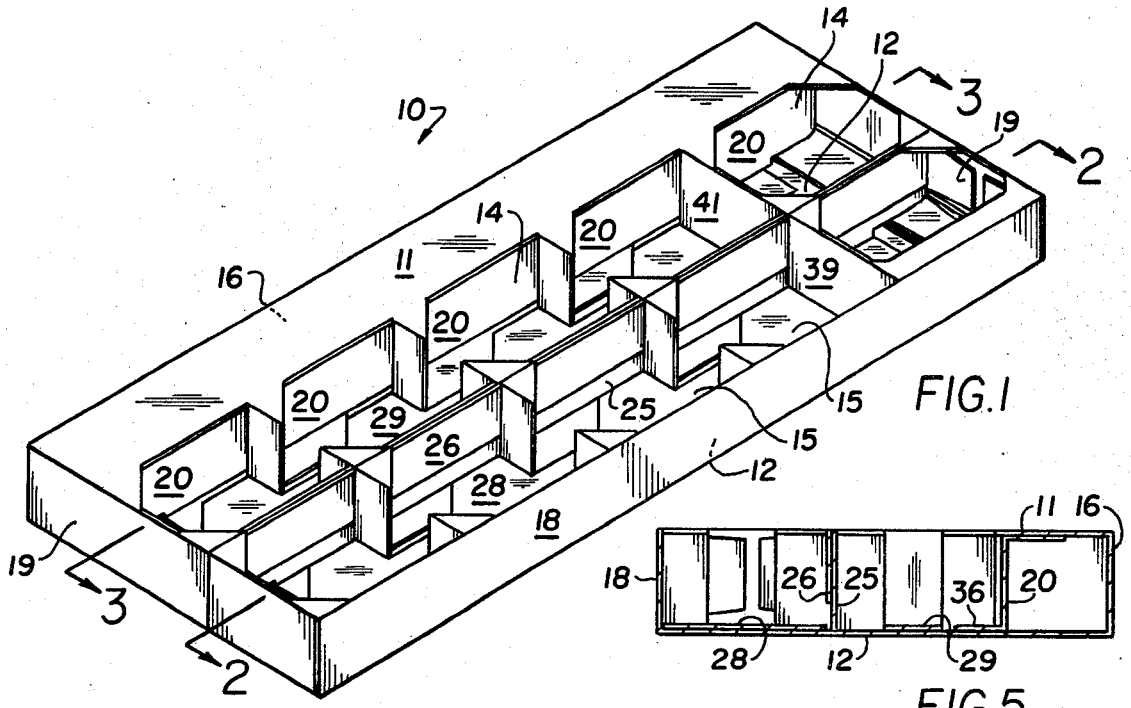
FIG.1
FIG.5
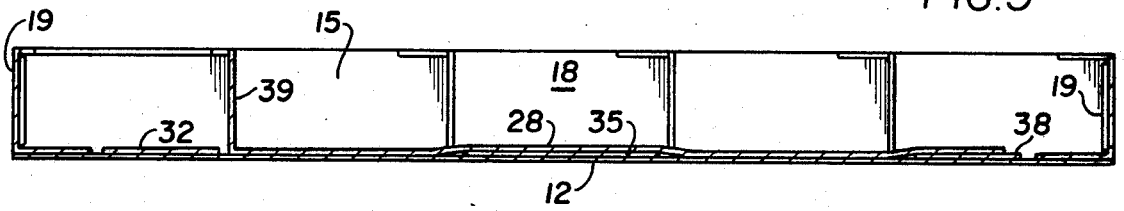
FIG.2
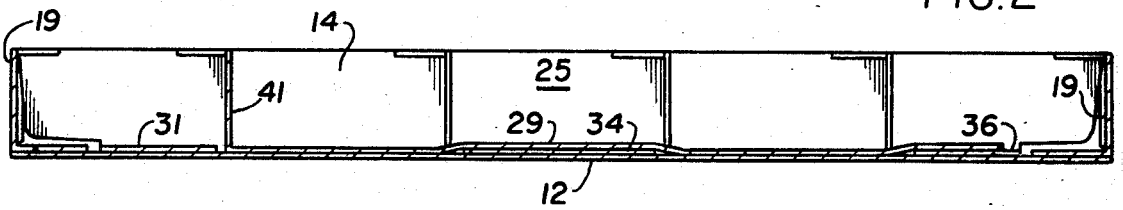
FIG.3
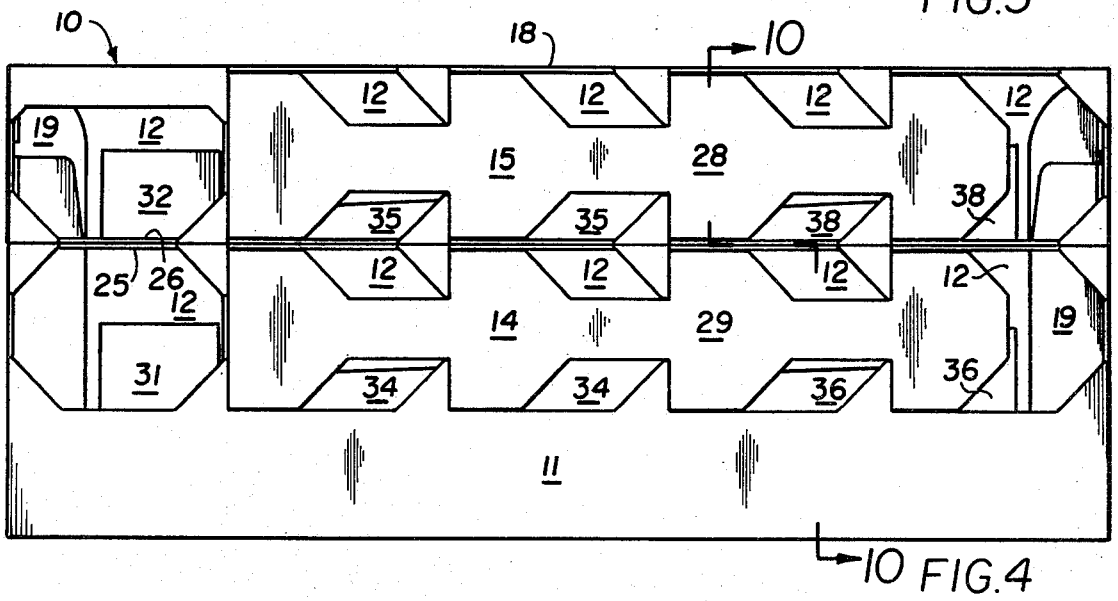
FIG.4

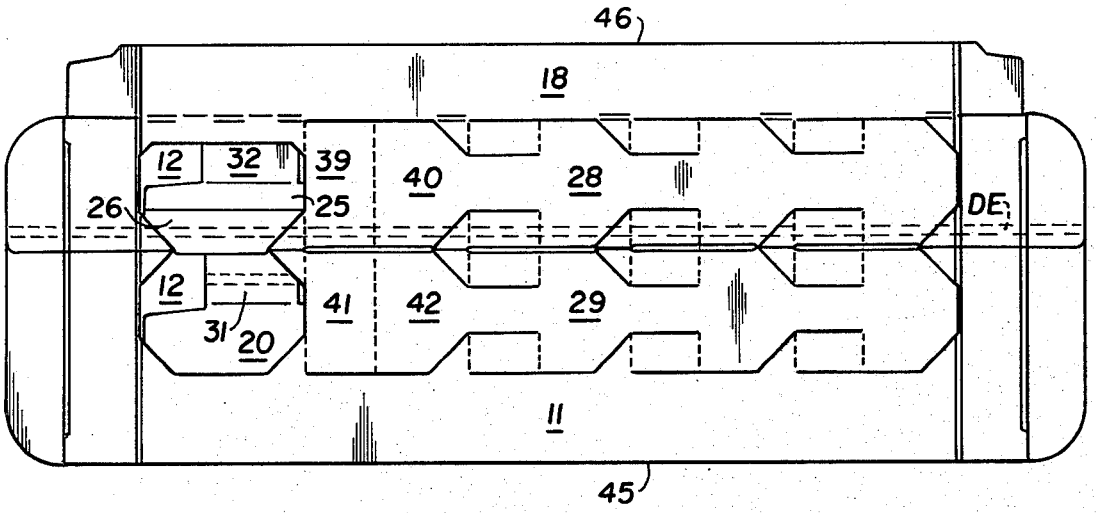
FIG.11
FIG.12
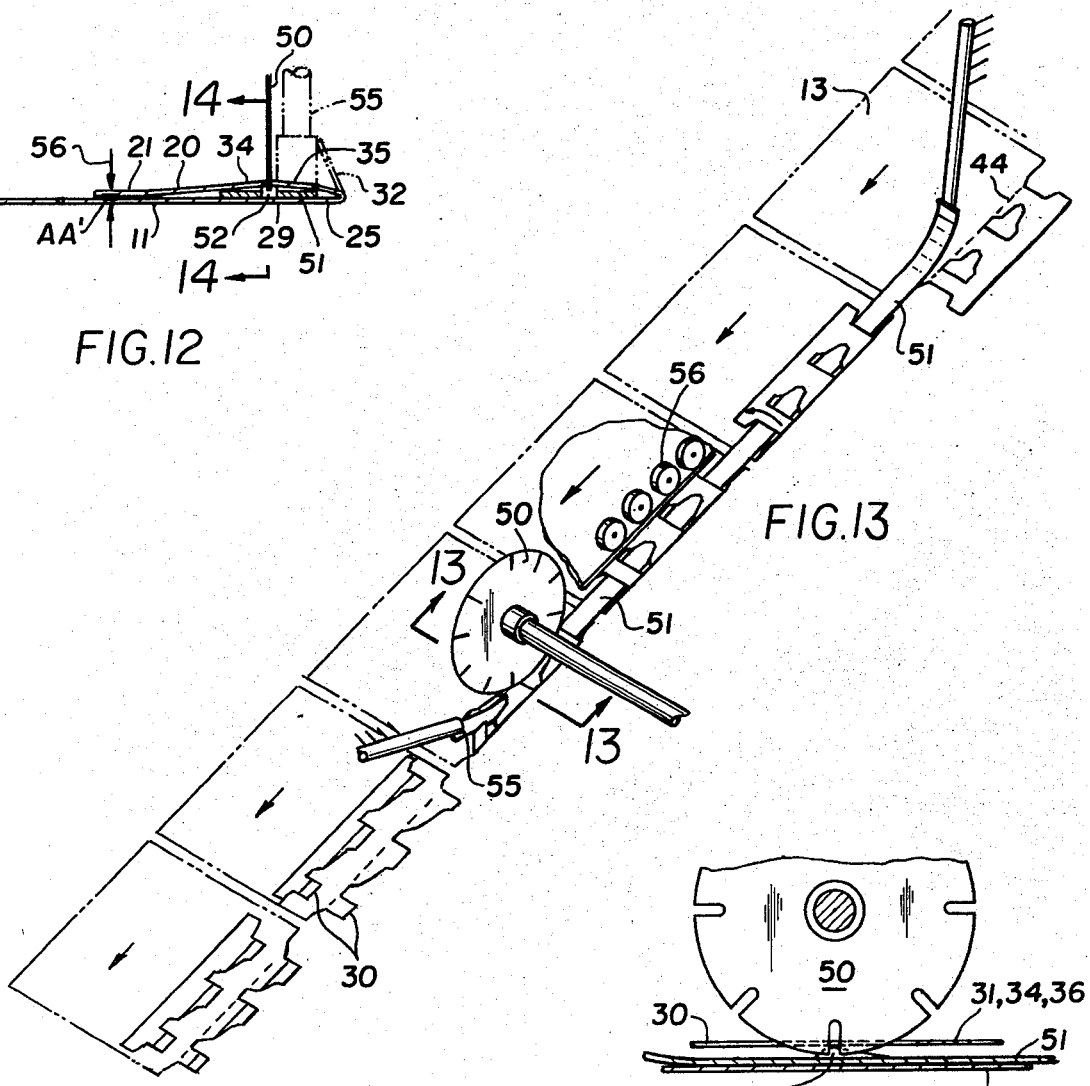
FIG.13
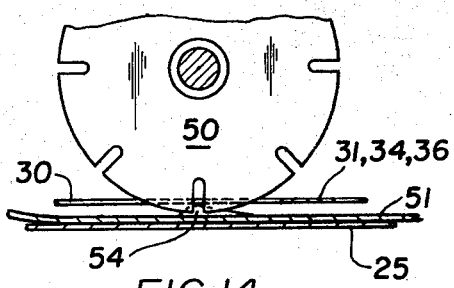
FIG.14

MULTICELL CARTON AND METHOD

BACKGROUND OF THE INVENTION

The subject invention relates to display cartons, and more particularly multicell display cartons which can be used for packaging candies, and other goods. The method looks to a technique which upgrades the speed of production, while at the same time permitting a reduction of board consumption over the prior art.

SUMMARY OF THE PRIOR ART

The prior art is best exemplefied by U.S. Pat. No. 4,274,579 issued June 23, 1981, and the prior art cited therein.

In the U.S. Pat. No. 4,274,579 patent it will be noted that emphasis is laid upon a double wall section divider strut characterized by reference numerals 27, 94. This necessitates an additional thickness of board which is not necessary to an integral carton construction. Furthermore, to be noted in U.S. Pat. No. 4,274,579 is a double thickness on the bottom or base, particularly as shown in FIGS. 3 and 4 of the drawings. This double bottom or partial double bottom effect can offset the advantages of locking by tilting the center portion of the gang lift.

SUMMARY

The present invention is directed to a multicell carton having a base element with side panels, and gang lift elements formed as an extension from the side panels. More specifically, a breakaway strut panel is integrally formed with the initial panel, and thereafter folded over and glued, and severed from the initial panel in order to define the divider strut between the two strut gang lift elements. A divider strut glue flap extends from one of the gang lift elements and is secured to the single thickness breakaway strut, thereby reducing the board construction from approximately 235 square inches for the carton as shown in U.S. Pat. No. 4,274,579 to 225 square inches or a 10 square inch saving amounting to a 4.3% reduction in the use of board. The method of the invention contemplates first glueing the breakaway strut portion to the graphic panel and then severing the same by sawing or otherwise cutting to form an independent element on the underneath portion of the graphic panel. Thereafter the strut fold score results in a 180° folding of the divider strut and its breakaway strut assembly to form the first gang element of the carton. Subsequently, the glue strip is adhered to the divider strut, the divider strut glue panel folded 180°, and the strut gang lift section folded along the final fold score to complete the glueing of the divider strut glue flap to the divider strut and complete the carton construction.

In view of the foregoing it is a principal object of the present invention to manufacture a multicell carton having the physical properties of the prior art, but accomplishing a board saving in excess of 4%.

A further and important object of the present invention is to provide a multicell carton having parallel gang lifts in which ones of the gang lift struts, when depressed, are applied directly against the base, and the foot locks apply directly against the base rather than on intermediate folded material thus assuring a better down-lock position of the strut gang lift and divider strut gang.

Yet another object of the present invention looks to the method of manufacture in which the breakaway strut element is reversely folded and severed. Manufacturing speeds in excess of 10,000 cartons per hour are achieved by this construction with an estimated average of 8,500 per hour. The prior art type construction as illustrated in U.S. Pat. No. 4,274,579 achieved at best a 6,500 carton per hour speed. Speeds of actually sustained manufacture at 12,500 cartons per hour have been achieved with the present construction and method, while utilizing hot melt or a cold glue for the original flueing step.

Further objects and advantages of the present invention will become apparent as the following description proceeds, taken in conjunction with the accompanying drawings, in which:

FIG. 1 is a perspective view of the subject carton;

FIG. 2 is a longitudinal sectional view taken through the strut gang lift along section line 2—2 of FIG. 1;

FIG. 3 is a longitudinal sectional view taken through the divider strut gang along section line 3—3 of FIG. 1;

FIG. 4 is a top view of the subject carton with the gang lifts in their depressed configuration;

FIG. 5 is a transverse sectional view taken along section line 5—5 of FIG. 4;

FIG. 11 is a plan view of the multicell carton in its knockdown configuration;

FIG. 12 is a perspective partially diagrammatic view showing the slitting sequence for severing the breakaway strut and its associated elements from the balance of the panel;

FIG. 13 is a transverse sectional view of the saw of FIG. 12 taken along section line 13—13 of FIG. 12; and FIG. 14 is a front sectional view of the saw taken along section line 14—14 of FIG. 13.

MULTICELL CARTON DESCRIPTION

Figure 6:
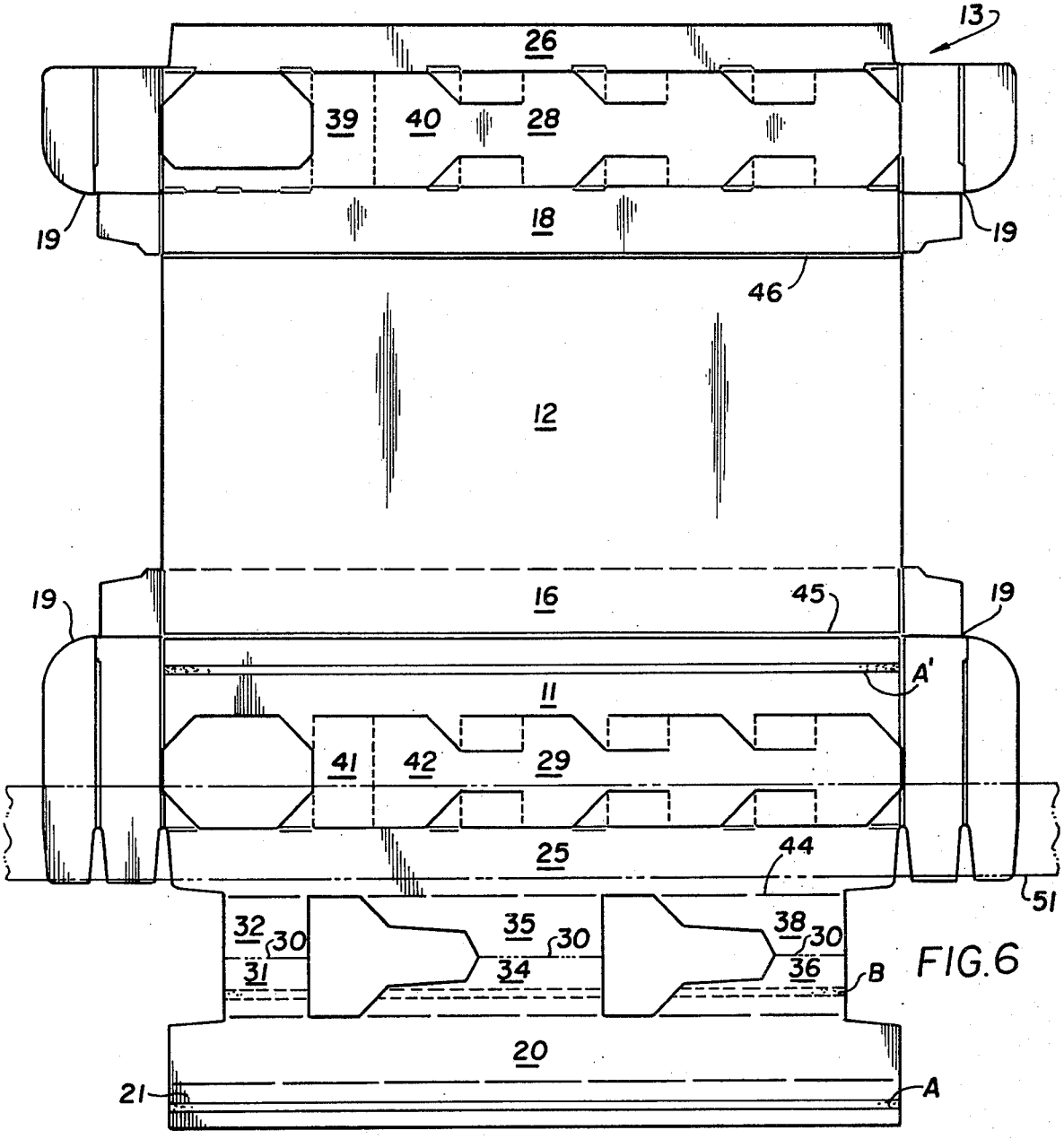
FIG. 6 is a plan view of the original panel.

The subject multicell carton 10 is shown in perspective view in its erected form in FIG. 1. There it will be seen that adjacent one side provision is made for a graphic panel 11. The basic building block of the carton 10 is a base 12 atop which graphic panel cells 14 and divider cells 15 are provided. In the instant carton provision is made for ten such cells 14, 15. Two side panels are provided, a breakaway strut side panel 16 and a gang lift side panel 18. End closures 19 are at both ends of the multicell carton 10.

The graphic panel cells 14 and the divider cells 15 are formed in part by a breakaway strut 20 and a divider strut 25. With reference now to FIG. 6, it will be seen that the entire multicell carton 10 is formed from a single panel 13. At the lower portion the breakaway strut 20 is shown, along with its adjacent breakaway strut glue flap 21. A divider strut 25 is provided to be secured by the divider strut glue flap 26. Two gang lifts 28, 29 are respectively provided for the breakaway strut 20 and the divider strut 25.

Provision is made in the method of forming the carton to sever the breakaway strut 20 from the panel 13 along cut lines 30 shown in sectional lines at the lower portion of FIG. 6. Prior to severing provision is made for opposed front breakaway strut and divider strut footlocks 31, 32 for the respective breakaway strut 20 and the divider strut 25. Similarly, middle breakaway strut and divider strut footlocks 34, 35 are provided in a mid-position and rear breakaway strut and divider strut footlocks 36, 38 are also formed when the severence occurs along the cut line 30. Cell dividers 39 and 41 are positioned adjacent the respective locking feet 40, 42. Breakaway fold 44 is creased along the panel 13 as well as the first fold line 45 and the final fold line 46.

THE METHOD

Figure 7:
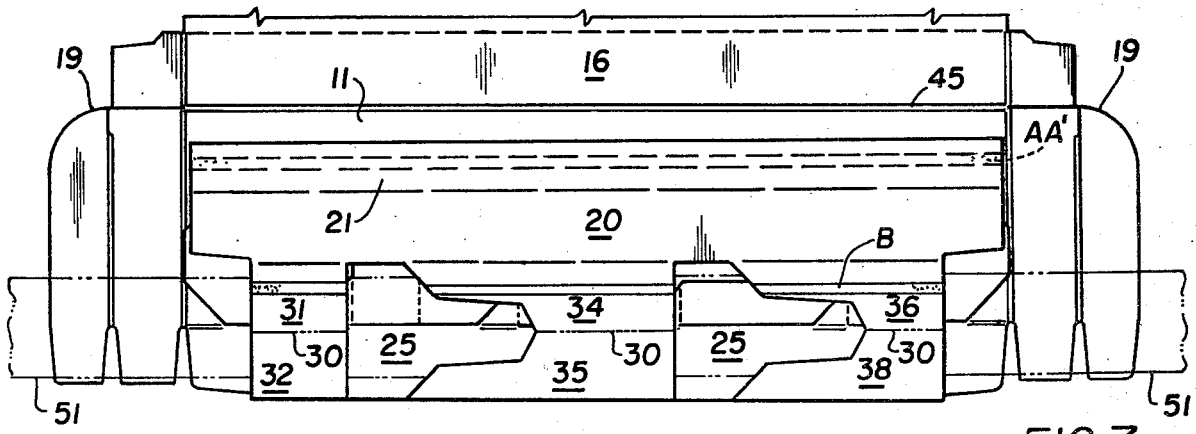
FIG. 7 is a plan view of the original panel but after the breakaway strut has been severed therefrom and glued to the underneath portion of the graphic panel.
Figure 8:
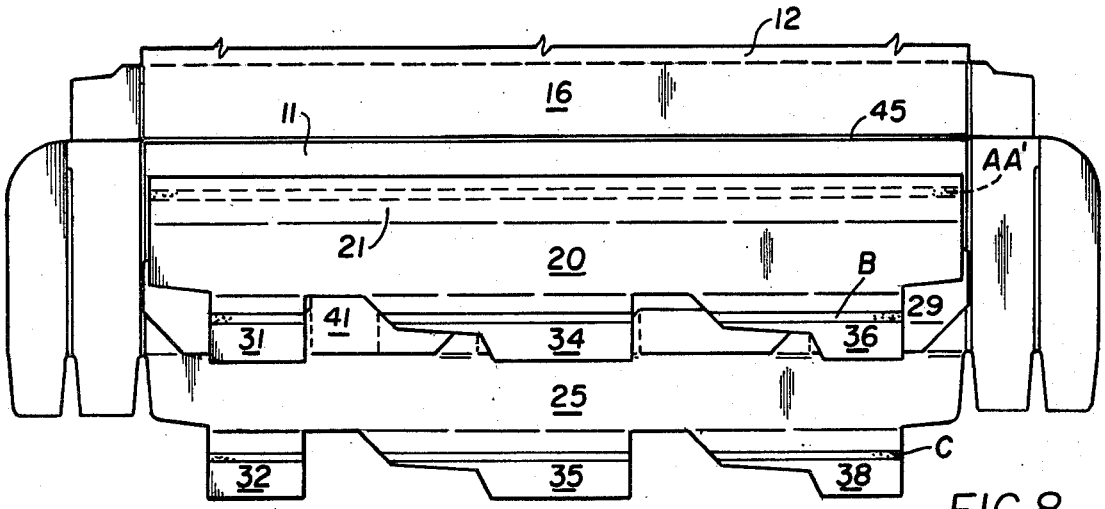
FIG. 8 is a plan view of the original panel following the configuration shown in FIG. 7 after the cut when the divider strut and its associated footlocks have been folded outwardly for a subsequent reverse fold into its glued position.

The method of forming the subject multicell carton 10 is shown in FIGS. 7–14. Prior to any folding, the glue lines A, A' and B are applied to the panel 13 of FIG. 6. Thereafter a reverse fold is made along the breakaway fold 44 and the breakaway strut glue flap 21 is joined to the underneath portion of the graphic panel 11 in the configuration as shown in FIG. 7. This sequence takes place, as shown in FIG. 12, prior to the engagement with the saw 50 and in overlapping engagement with the tongue 51. The panel 13 is moved forwardly as shown in the sequence in FIG. 12 and engaged by the roller assembly 56 to assist in adhering the breakaway strut glue flap 21 to the graphic panel 11. Particularly as shown in FIG. 13, a tongue slot 52 is provided near the end portion of the tongue 51 and is penetrated by the saw 50. A spreader 54 (see FIG. 14) is provided on one of the extensions of the tongue 51 defined by the slot 52 to raise the board permitting a separation of the saw 50 from the divider strut 25 and upon slitting the front footlock 31, middle footlock 34, and rear footlock 36 are formed sequentially as shown in FIG. 14. An X-ACTO blade will also form the same slit. Thereafter the plow 55 reversely folds the front footlock 32, middle footlock 35, and rear footlock 38 to the configuration as shown in FIG. 8.

Figure 9:
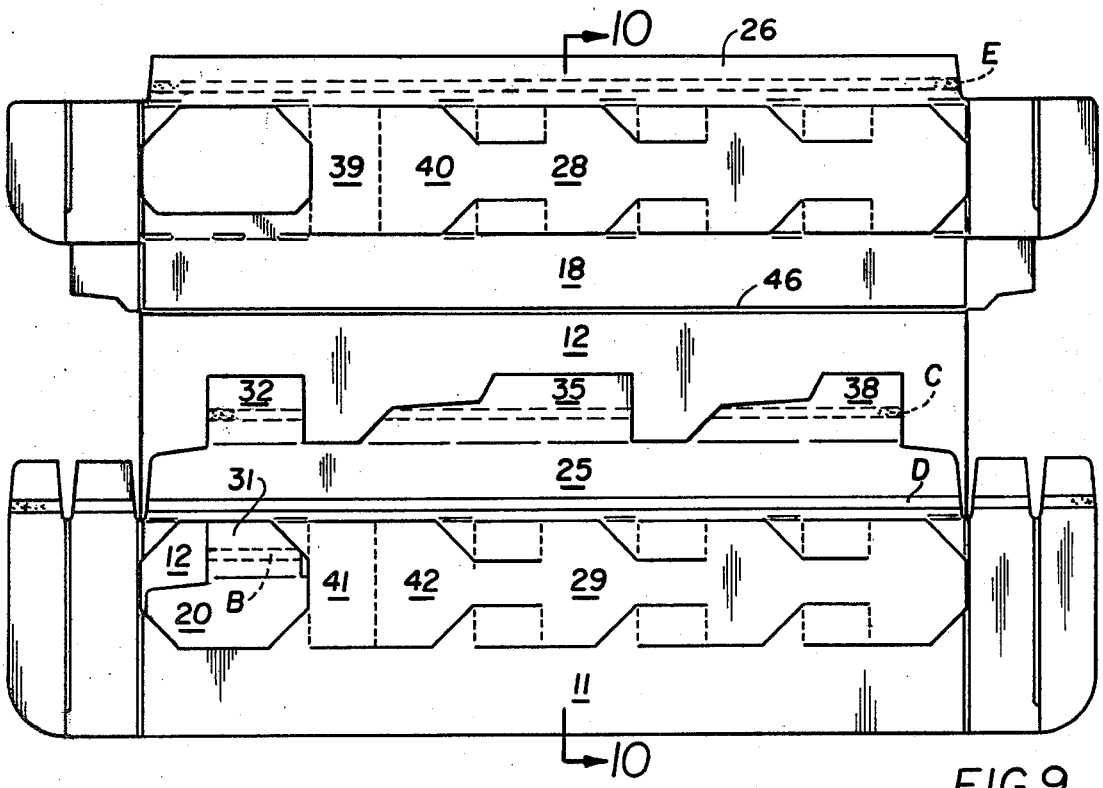
FIG. 9 is a view subsequent to that shown in FIG. 8 when the divider strut has been reversely folded along the first fold adjacent the graphic panel.
Figure 10:
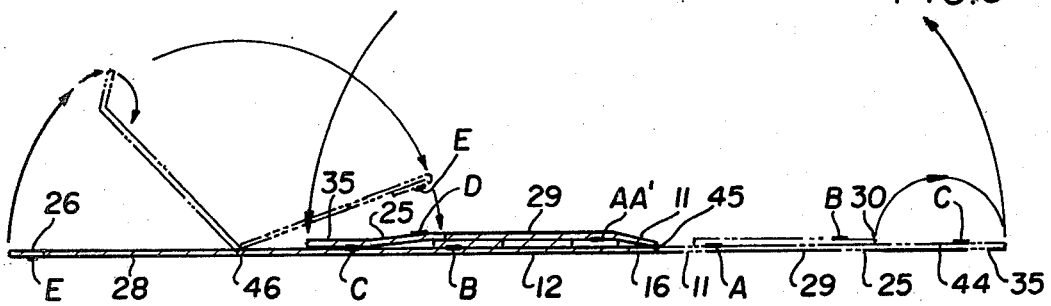
FIG. 10 is a partially diagrammatic view showing the sequences of folding and glueing of the carton.

The next step in the carton formation is to insure the application of glue lines B, C as shown in FIG. 8, and then to reversely fold along first fold line 45 of FIG. 8 and to glue into the configuration as shown in FIG. 9. Thereafter glue lines D and E are applied, and the carton subsequently folded over the final fold line 46 of FIG. 9 to secure the carton in the configuration essentially as shown in FIG. 11. The final fold is shown in FIG. 10 diagrammatically at the left-hand side, whereas the breakaway step and first fold are shown at the right-hand portion of FIG. 10.

When the carton is to be erected into the configuration as shown in FIG. 1, the sides are squeezed together so that the breakaway strut side panel 16 and gang lift side panel 18 are perpendicular to the base 12. Thereafter the two gang lifts 28, 29 are depressed into the locked configuration with the respective footlocks 31, 32, 34, 35, 36, 40, 42 with the cell dividers 39, 41 taking a vertical configuration essentially perpendicular with the base 12. The end closures 19 are tucked into position in sequence and the carton is ready for filling with goodies such as chocolate eggs, and other confections which can be readily observed in the carton.

Although particular embodiments of the invention have been shown and described in full here, there is no intention to thereby limit the invention to the details of such embodiments. On the contrary, the invention is to cover all modifications, alternatives, embodiments, usages and equivalents of the multicell carton as fall within the spirit and scope of the invention, specification, and appended claims.

I claim:

1. A blank panel for forming a multicell carton comprising, in combination,
   - a base,
   - a gang assembly having a graphic panel,
   - a breakaway strut section having opposed foot locks which when severed and displaced defines an independent strut with foot locks glued to the base and a glue flap underneath the graphic panel,
   - a gang lift side panel at one edge of the base adjacent a fold score line,
   - said breakaway strut side panel being at the opposed portion of the base and terminating in a strut fold score,
   - a divider strut gang,
   - a divider strut having foot locks,
   - a divider strut glue flap comprising the portion of the panel opposite the breakaway strut section,
   - said divider strut glue flap being secured to a strut gang lift extending from the gang lift side panel,
   - and means extending from the ends of the strut gang lift and divider strut gang for closing the end portion of the carton.

2. A multicell carton comprising, in combination,
   - at least one strut gang lift to form cells in opposed relationship to a base,
   - a second divider strut gang to form cells,
   - a graphic panel,
   - side panels flanking the base, one of which is joined to the graphic panel,
   - a breakaway strut section having opposed foot locks, which when severed and displaced, defines an independent strut with foot locks glued to the base and a glue flap underneath the graphic panel,
   - and wherein the divider strut is secured to a divider strut glue flap at a position longitudinally central of the carton dividing the gang lift cells.

3. A multicell carton formed from a carton blank comprising, in combination,
   - a pair of gang lift elements,
   - a base,
   - side panels,
   - a divider strut,
   - a graphic panel,
   - a breakaway strut section, having opposed front foot locks, middle foot locks, and rear foot locks, severed and displaced from said carton blank to define an independent breakawaay strut with foot locks glued to the base and a glue flap underneath the graphic panel,
   - said breakaway strut having a single thickness and being joined by a divider foot at its base to the bottom of the carton and being joined with a glue flap on the underneath side of the graphic panel.

4. The method of manufacturing a multicell carton having adjacent parallel rows of cells divided by a strut in which the cells include a gang lift secured to the base by foot locks, comprising the steps of,
   - inserting a plurality of blanks sequentially into a line gluer machine and advancing the same linearly while folding, gluing, and cutting is performed in sequence, folding a lateral portion of the panel to secure a breakaway strut glue flap and its adjacent breakaway strut to an underneath portion of a graphic panel, severing the just-recited portion of the panel from the divider strut and adjacent opposed foot locks at their mid point, glueing the breakaway strut foot locks and divider strut foot locks to the base by reversely folding along a fold line which divides a breakaway strut side panel from the graphic panel, thereafter reversely folding a divider strut glue flap at a position opposed from the breakaway strut, applying glue to the divider strut, and thereafter folding along a final fold score line dividing the gang lift side panel from the base so that the divider strut glue flap is glued to the divider strut.

5. In the method of claim 4 above, isolating the breakaway strut and its adjacent foot locks from the divider strut by means of a tongue therebeneath, and after isolating the same positioning a cutting element to cut the upper portion after the breakaway strut glue flap has been secured to the underneath portion of the graphic panel thereby providing a positively oriented breakaway strut independent element to the panel while flowing through the folding and glueing operation.

6. In the method of claim 5 above, positioning a saw at an end portion of the tongue to cut the breakaway strut and its associated elements for the panel.

7. In the method of claim 5 above, positioning a spreader adjacent the tongue and to separate the board for cutting.

8. In the method of claim 6 above, positioning a spreader adjacent the tongue and to separate the board for cutting.

* * * * *